United States Patent [19]

Grubb et al.

[11] 4,091,531

[45] May 30, 1978

[54] TOOL FOR SIMULTANEOUSLY STAKING A PLURALITY OF WIRES INTO AN ELECTRICAL CONNECTOR

[75] Inventors: Daniel Baker Grubb, Hummelstown; William Ludlow Schumacher, Camp Hill; Robert Volinskie, Hershey, all of Pa.

[73] Assignee: AMP Incorporated, Harrisburg, Pa.

[21] Appl. No.: 683,595

[22] Filed: May 5, 1976

[51] Int. Cl.[2] ..... H01R 43/04

[52] U.S. Cl. ..... 29/749; 29/753

[58] Field of Search ..... 29/203 DT, 203 MW, 203 D, 29/203 H, 203 HT, 203 J, 203 P, 628, 749, 751, 753, 760

[56] References Cited

U.S. PATENT DOCUMENTS

| | | | |
|---|---|---|---|
| 3,956,811 | 5/1976 | Munshower | 29/203 DT X |
| 4,017,954 | 4/1977 | Grubb | 29/749 |
| 4,020,540 | 5/1977 | Casciotti et al. | 29/749 |

*Primary Examiner*—Carl E. Hall
*Attorney, Agent, or Firm*—Allan B. Osborne

[57] ABSTRACT

The invention relates to a tool and a method for simultaneously staking a plurality of wires into an electrical connector of the type having two rows of contact members, one row overlying the other. More particularly, the tool includes a connector support assembly on the moving ram member. This moving assembly holds the connector so that the openings of the wire-in-slot blades face downwardly. A wire support assembly is positioned on the lower, stationary member. The wires to be staked into the contact members are dressed across a series of plates having functionally-related posts and slots. The connector is brought down onto the stationary assembly which supports the wires so that the wire-in-slot blades may be pushed onto them. Both assemblies include lateral restraining members which confine the blades during the staking operation.

7 Claims, 12 Drawing Figures

TOOL FOR SIMULTANEOUSLY STAKING A PLURALITY OF WIRES INTO AN ELECTRICAL CONNECTOR

BACKGROUND OF THE INVENTION

1. Field of the Invention

The simultaneous staking of a plurality of wires into wire-in-slot blades on contact members positioned in two rows, one row being positioned over the other.

2. Description of the Prior Art

A U.S. Pat. No. 3,775,552 issued on Nov. 27, 1973 disclosing a ribbon coaxial cable of the type having a plurality of signal wires, each protected by its own shielding, and each being paralleled by a drain wire in contact with the shielding.

Subsequent thereto a connector was invented and disclosed in U.S. Pat. No. 3,864,011. This connector, developed for ribbon coaxial cable consisted of contact members having wire-in-slot blades and a housing having a plurality of passages arranged in two rows, one row over the other. Further, the passages in one row were designed to accept the contact members so that the blades or more particularly the openings to the wire-receiving slots faced in one direction and the passages in the other row were designed so that the openings to the slots in those contact members faced in the opposite direction.

Thereafter a tool was invented wherein the connector was inserted and the assembly therein would stake all the signal wires simultaneously into the wire-receiving slots on the contact members in one row. The connector would be withdrawn from the tool, turned over and reinserted. Thereafter all the drain wires would be staked simultaneously into the wire-receiving slots on the contact members in the second row. An application, Ser. No. 615,273, disclosing this tool was filed in the United States Patent and Trademark Office on Sept. 22, 1975 is now U.S. Pat. No. 4,017,954.

Subsequently a connector was invented which consisted of two sets of contact members, all having wire-in-slot blades but with one set having such blades offset to the right and the second set having such blades offset to the left. The housing for these contact members contains a plurality of passages arranged in two rows, one row over the other. The back face of the passages each have a rearwardly extending platform on which the blades rested: the platforms on one row being offset to the right and the platforms on the second row being offset to the left. This arrangement permitted the passages to be in direct overlying alignment while permitting direct and simultaneous access to all the wire-in-slot blades in both rows. This connector is disclosed in an application, Ser. No. 683,575, filed concurrently herewith and incorporated herein by reference.

The tool of the present invention was invented to simultaneously stake or terminate all signal and drain wires into the wire-in-slot blades in the above-described connector. With one stroke of the tool the signal wires are staked into the contact members occupying one row of passages and the drain wires are staked into the contact members occupying the other row.

SUMMARY OF THE PRESENT INVENTION

The present invention provides a tool having a wire support assembly mounted on a lower, stationary base and a connector support assembly mounted on the upper, movable member. The connector support assembly, retains the connector during the staking operation. The wire support assembly consists of a series of functionally-related posts and slots. The connector, containing a plurality of contact members is placed in the connector support assembly so that the openings to the wire-in-slot blades are facing downwardly. Several sets of posts of the assembly restrain the blades in the upper rows of contact members against lateral movement. A wire cutoff plate is included as part of the moving assembly.

The several wires comprising a ribbon cable are placed in the wire support assembly, the comb dressing the wires so that they lay across the series of posts and slots in a predetermined order. As the connector support assembly descends, the wire cutoff plate shears and trims the ends of the wires protruding beyond the wire support assembly. Thereafter the wire-in-slot blades are pushed onto the wires, the posts and bases of the slots in the wire support assembly providing the wire support means.

LISTING OF THE ELEMENTS

Figure 1:
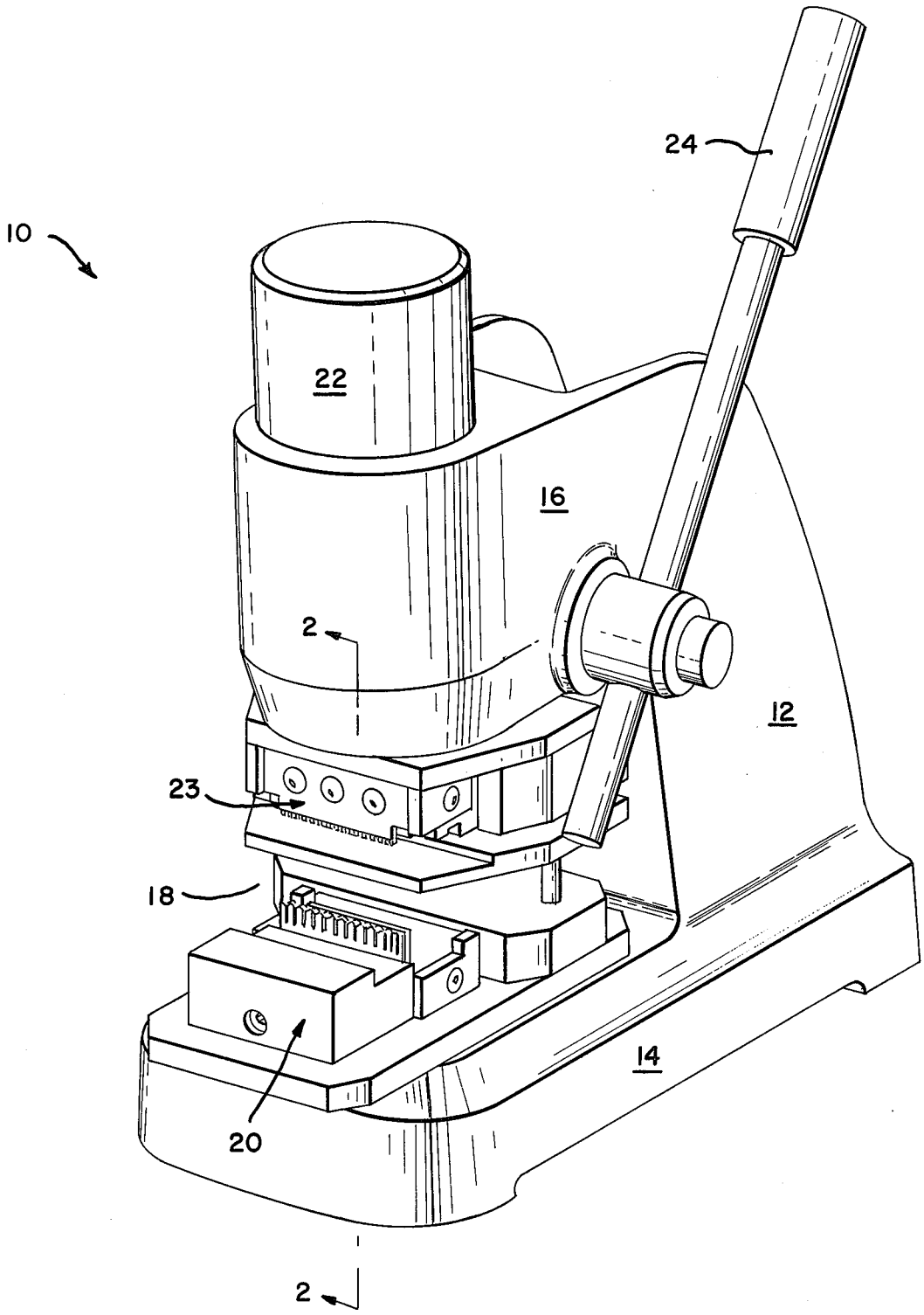
FIG. 1 is a perspective view of the tool containing the preferred embodiments of the present invention.

10 - Tool
12 - C-shaped frame
14 - Base
16 - Upper support member
18 - Work space
20 - Lower assembly
22 - Ram
23 - Upper assembly
24 - Handle (ram)
20 - Lower Assembly
26 - Base plate
28 - Cable support block
30 - Comb and stake assembly retaining unit
32 - Guide block
36 - Block
38 - Comb and stake assembly
40 - Side panels
42 - Vertical posts
46 - Dowel pins
105 - Machine screws
38 - Wire Support Assembly
50 - Comb plate
51 - Posts
52 - Short slots
54 - Long slots
58 - First wire support plate
60 - Posts -continued

LISTING OF THE ELEMENTS

62 - Slots
64 - First blade support plate
66 - Posts
68 - Slots
72 - Second wire support plate
74 - Posts
76 - Slots
78 - Back side
80 - Leg
81 - Cross-tie portion
84 - Upwardly facing shoulder
86 - Second blade support plate
220 - Posts
222 - Slots
88 - Third wire support plate
90 - Posts
92 - Slots
94 - Floating comb
96 - Arcuate notches
98 - Posts
100 - Slots
102 - Leaf spring
104 - Bight
106 - Free ends
23 - Upper Assembly
48 - Wire cutoff plate
110 - Connector support assembly
112 - Upper mounting block
154 - Shouldered pin
160 - Shoulder
162 - Four studs
208 - Forwardly facing shoulder
114 - Upper side panels
116 - Upper block support plate
110 - Connector Support Assembly
122 - Cover plate
124 - First support plate
126 - Posts
128 - Slots
132 - First platform support plate
134 - Second support plate
136 - Posts
138 - Slots
140 - Second platform support plate
142 - Locator plate
144 - Beveled teeth
146 - Slots
147 - Rear bevel on teeth
48 - Wire Cutoff Plate
148 - Forward shelf
150 - Forwardly facing shoulder
152 - Forward bottom cutting edge
156 - Opening (to receive pin 154)
158 - Counterbore (to receive shoulder 160)
170 - Connector
172 - Housing
174 - Passages
175 - Back end
176 - Platform
U - Upper
L - Lower
210 - Space between platforms
206 - Front end
178 - Contact members
U - Upper
L - Lower
180 - Terminal section
182 - First wire-in-slot blades
184 - Second wire-in-slot blades
186 - Second side on U-shaped portion
188 - Wide slot
190 - Bight on the U-shaped portion
192 - Wire-receiving slots
194 - Contact arms
196 - Intermediate section (between 180–194)
198 - Ribbon coaxial cable
200 - Signal wires
202 - Drain wires
204 - Insulating jacket
205 - Cable end

DESCRIPTION OF THE PREFERRED EMBODIMENT

The hand operated tool 10 shown in perspective in FIG. 1 is but one type of mechanism which can be used in practicing the present invention. The tool has a C-shaped frame 12 with a base 14, an overhead support member 16 and a work space 18 inbetween. The base 14 provides support for the lower assembly 20 of the present invention. The overhead support member 16 accommodates a movable ram 22, upper assembly 23, ram-actuating handle 24 and mechanism (not shown) connecting the two. These elements of tool 10, i.e., the frame, base, ram, handle and so forth (excluding assemblies 20 and 23) are well known in the industry and do not per se form a part of this invention.

Figure 2:
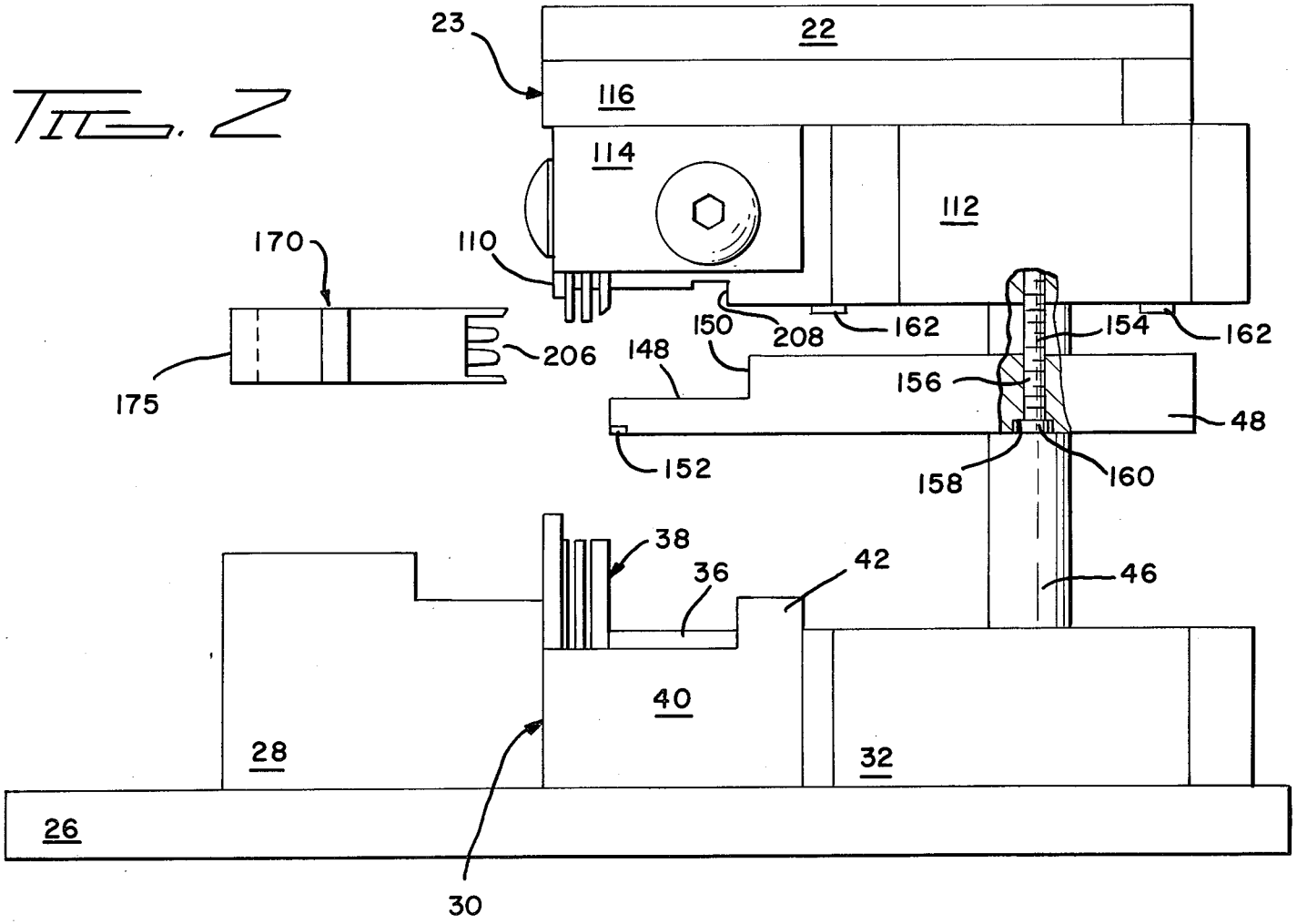
FIG. 2, taken along lines 2—2 of FIG. 1, is a side elevational view looking into the area where the cutting and staking operations occur.

The lower assembly 20 is shown in FIGS. 1–3, 5 and 7, 8. With reference specifically to FIG. 2 and generally to the others, the assembly includes a base plate 26 on which are positioned three units; the cable support block 28 to the left, a wire support assembly retaining unit 30 in the middle and the guide block 32 to the right.

The cable support block 28, in addition to providing a rest for the cable, aids in securing the wire support assembly in the front face of unit 30.

The retaining unit 30 includes a block 36, the wire support assembly 38 and a pair of side panels 40, one on either side of the block. The wire support assembly 38 is also shown in an exploded view in FIG. 3.

The two side panels 40 have a vertical post 42 which provides stop means for the tool's moving members.

Guide block 32 holds two vertical dowel pins 46, one on either side. The wire cutoff plate 48 slides up and down on these pins but only under an applied force.

Figure 3:
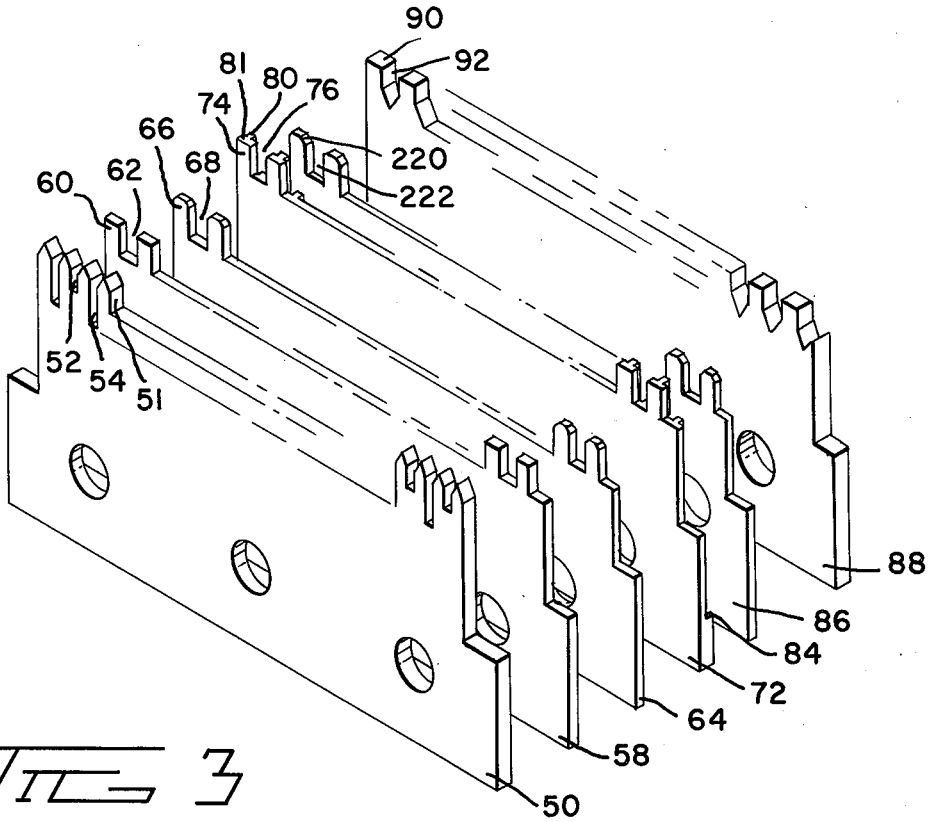
FIG. 3 is an exploded, perspective view of the wire support assembly.

Referring to FIG. 3, the wire support assembly consists of a number of plates beginning with the comb plate 50 which is on the left of the drawing.

Comb plate 50 has on its upper edge a plurality of beveled posts 51 defining short slots 52 alternating with long slots 54.

The second plate from the left is the first wire support plate 58. Its upper edge consists of a plurality of flat-topped posts 60 and a plurality of slots 62.

The third plate from the left is the first blade support plate 64. The upper edge of the plate consists of a plurality of posts 66 and slots 68.

The fourth plate from the left is the second wire support plate 72. Its upper edge consists of a plurality of T-shaped posts 74 and slots 76, the bases of which are also T-shaped.

Plate 72 is preferably milled out from a thick sheet of metal to provide the legs 80 of the T-shaped posts and slots bases. The cross-tie portions are designated by reference numeral 81. The base of the plate, on its back surface 78, has a thick section to provide an upwardly facing shoulder 84. With reference to FIGS. **4*a* and 4*b*, it can be seen that legs 80 need not extend much below the base of slots 76**.

The fifth plate is the second blade support plate 86 and it too has a plurality of posts 220 and slots 222 on its upper edge.

The last plate shown in FIG. 3 is the third wire support plate 88. Its upper edge consists of a plurality of posts 90 and bottom slots 92. The third wire support plate has a second function of providing a shearing edge to cooperate with the wire cutoff blade 48. Slots 92 are V-shaped to provide better cutting by the blade 48.

The six plates shown in FIG. 3 are held together by three machine screws (not shown) passing through the openings in the lower half of each plate and received in threaded apertures (not shown) in block 36.

Figure 4C:
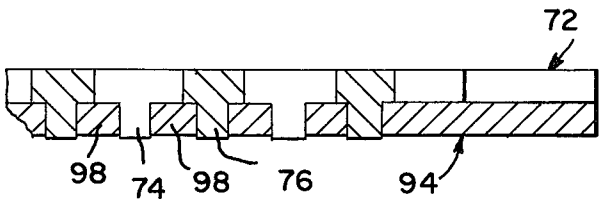
FIGS. 4*b* and 4*c* are views taken along lines 4*b*—4*b* and 4*c*—4*c* of FIG. 4*a;*
Figure 4A:
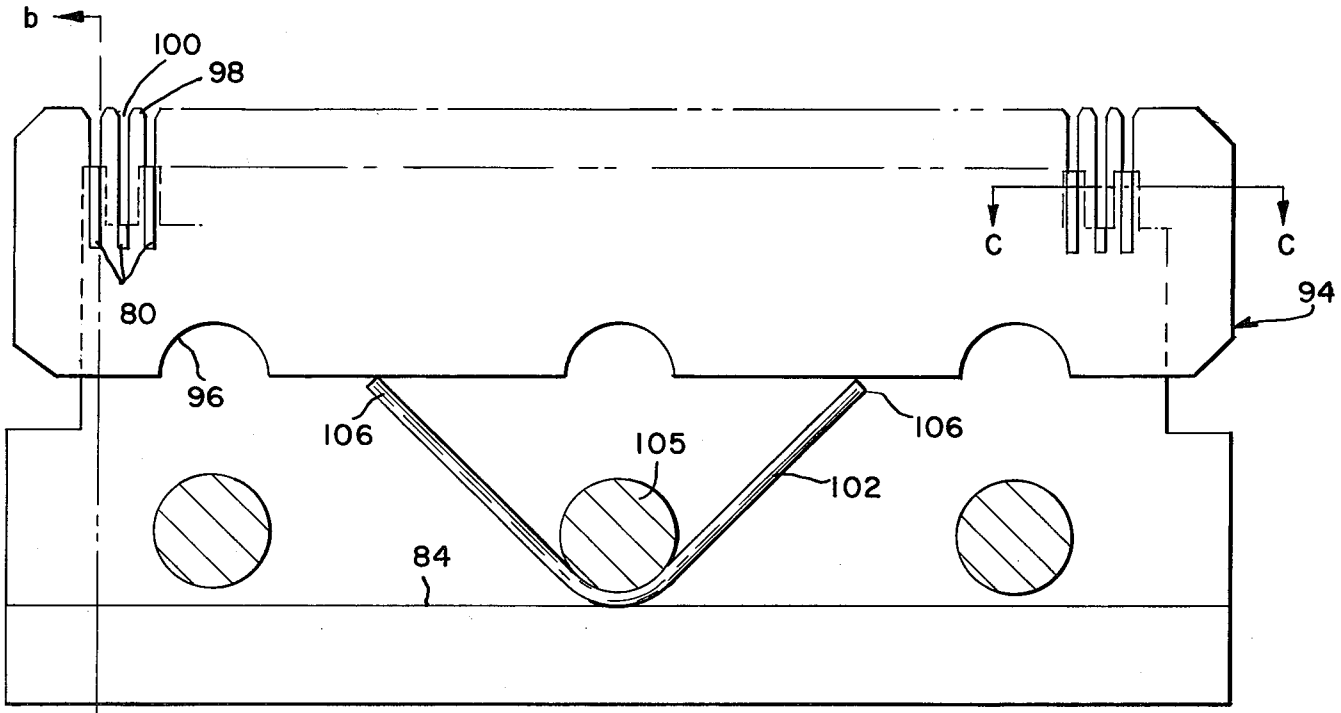
FIG. 4*a*, taken along lines 4—4 of FIG. 2, shows the floating comb optionally provided on the wire support assembly of FIG. 3.
Figure 4B:
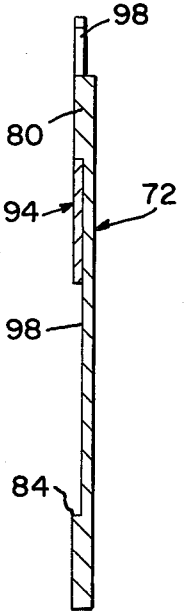
Figure 7:
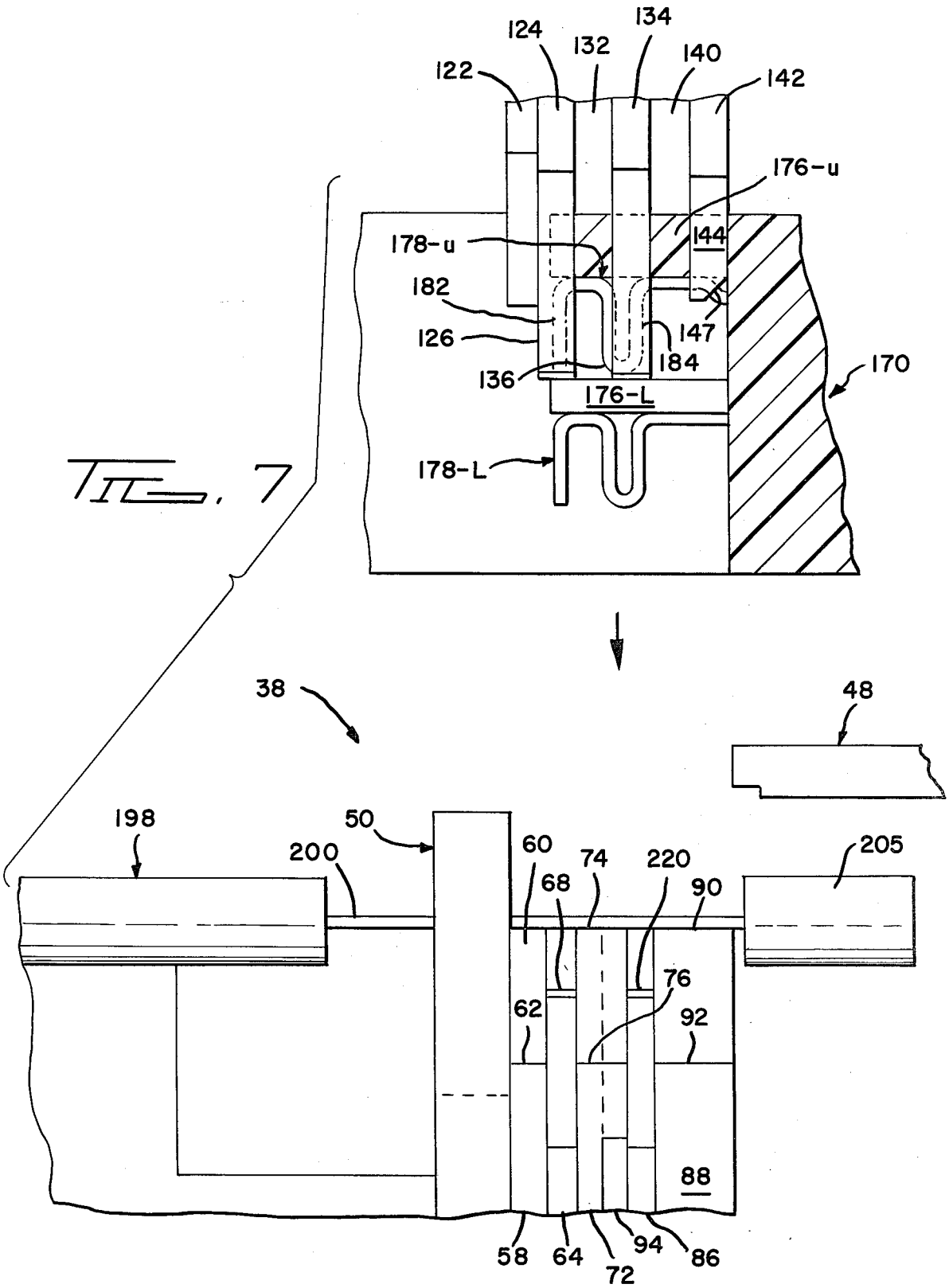
FIGS. 7 and 8 are side elevational, cross-sectional views illustrating the staking, terminating and wire-cutting operations of the tool of FIG. 1.
Figure 8:
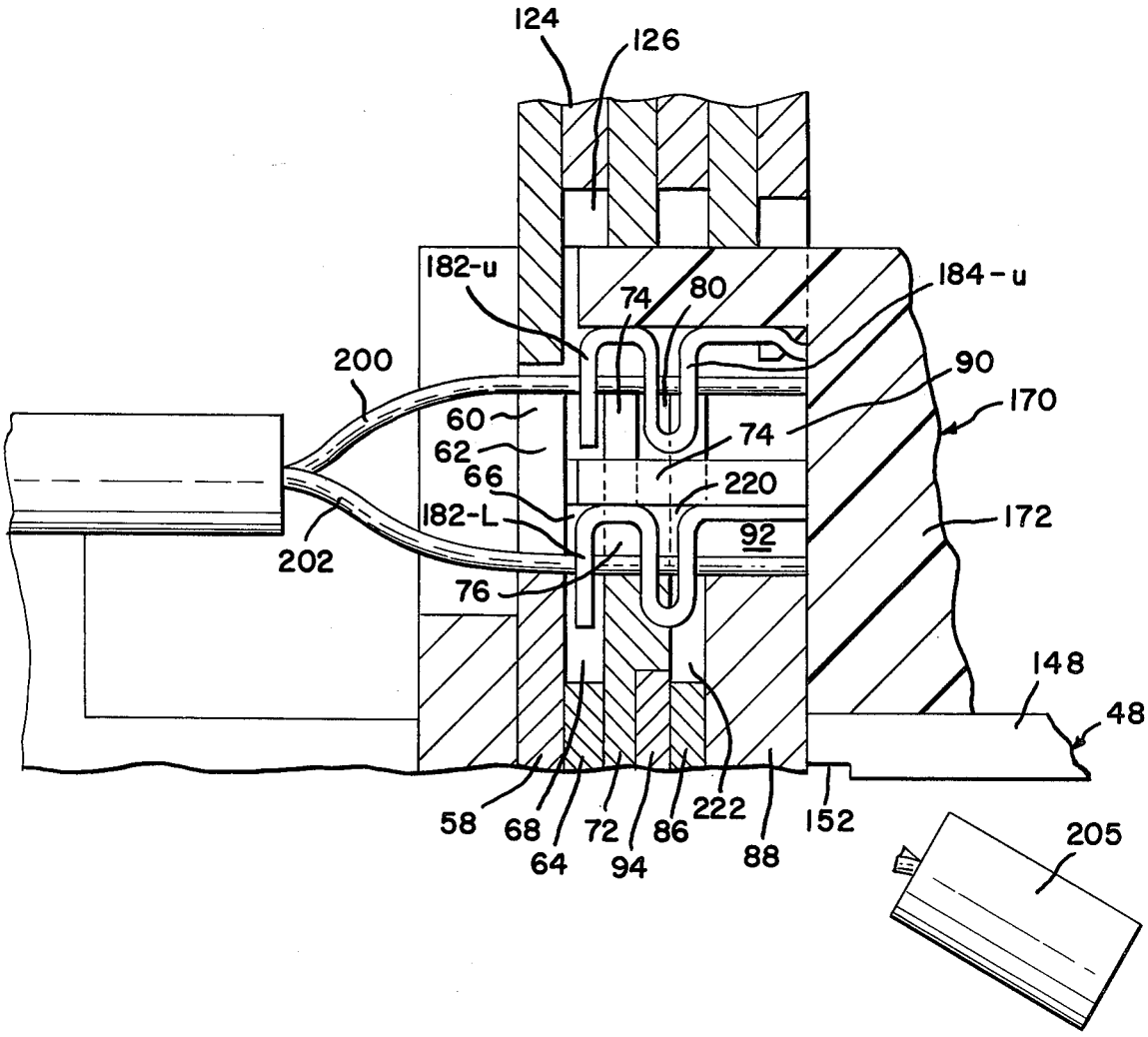

As shown in FIG. 2, 7 and 8, the wire support assembly may also include a second comb adapted to keep the wires aligned during the staking operation. FIGS. **4*a*, 4*b* and 4*c* illustrate this second comb which is hereinafter designated as floating comb plate 94. The comb itself consists of a half plate having three arcuate notches 96 along its bottom edge. Its upper edge consists of a plurality of posts 98 which define a plurality of slots 100. The comb is positioned against the back surface 78 of plate 72 with the legs 80 of the T-shaped posts and slot bases located in slots 100. FIGS. 4***b* and 4*c* illustrate this positioning quite clearly.

The floating comb 94 is biased upwardly by a simple V-shaped leaf spring 102. The bight 104 of the spring is positioned between the center screw 105 and shoulder 84 on plate 72. The two free ends 106 of the spring abut the bottom surface of plate 94. During the staking operation the floating comb is pushed down out of the way. The arcuate notches provide clearance of the attachment machine screws.

It is to be noted here that the wire support assembly can function with or without floating comb 94.

With reference to FIG. 2, upper assembly 23 includes the wire cutoff plate 48, the connector support assembly 110, an upper mounting block 112, a pair of upper side panels 114, and an upper block support plate 116 positioned between block 112 and ram 22. The function of the side panels are to insure lateral alignment of the assembly 110.

Figure 5:
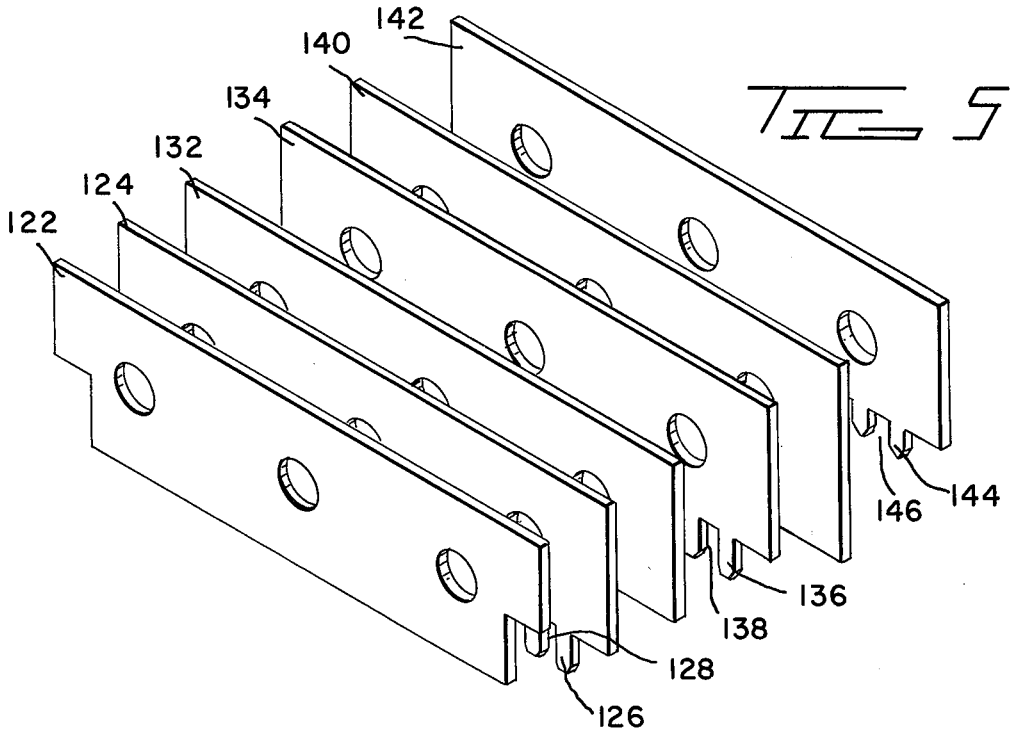
FIG. 5 is an exploded, perspective view of the connector support assembly.

The connector support assembly 110 is shown in exploded fashion in FIG. 5. Its orientation in the drawing is the same as it is shown in FIGS. 1 and 2.

The first plate on the left is cover plate 122. Its function is to provide proper spacing of the following plates with respect to the underlying wire support assembly 38.

The second plate from the left is the first support plate 124. The lower edge consists of a plurality of depending posts 126 which define slots 128 therein between. The free ends of the posts are beveled on either side.

The third plate from the left is the first platform support plate 132. Its edges are straight.

The fourth plate from the left is the second support plate 134. Its lower edge is identical to that of plate 124 in that it consists of a plurality of posts 136 and slots 138.

The fifth plate from the left is the second platform support plate 140. Its edges are straight.

The sixth and last plate is locator plate 142. Its lower edge has a plurality of beveled teeth 144 and slots 146. In addition the back side of each tooth is beveled as shown in FIG. 7 and indicated by reference numeral 147.

With reference to FIG. 2, wire cutoff plate 48 has a forward shelf 148 and a forwardly facing shoulder 150. The forward bottom cutting edge 152 is inclined from one side to the other to provide a progressive cutting blade in conjunction with plate 88 of the wire support assembly 38.

Plate 48 is attached to block 112 by a shouldered pin 154 passing through an opening 156 which is centrally located between the openings (not shown) in the plate which receives the dowel pins 46. The base of opening 156 has a counterbore 158 on which the shoulder 160 on the pin bottoms. The plate slides freely on pin 154.

Four studs 162 (two of which are shown) on block 112 provide proper stand-off between that block and plate 48 during downward travel of the upper assembly 23.

Figure 6A:
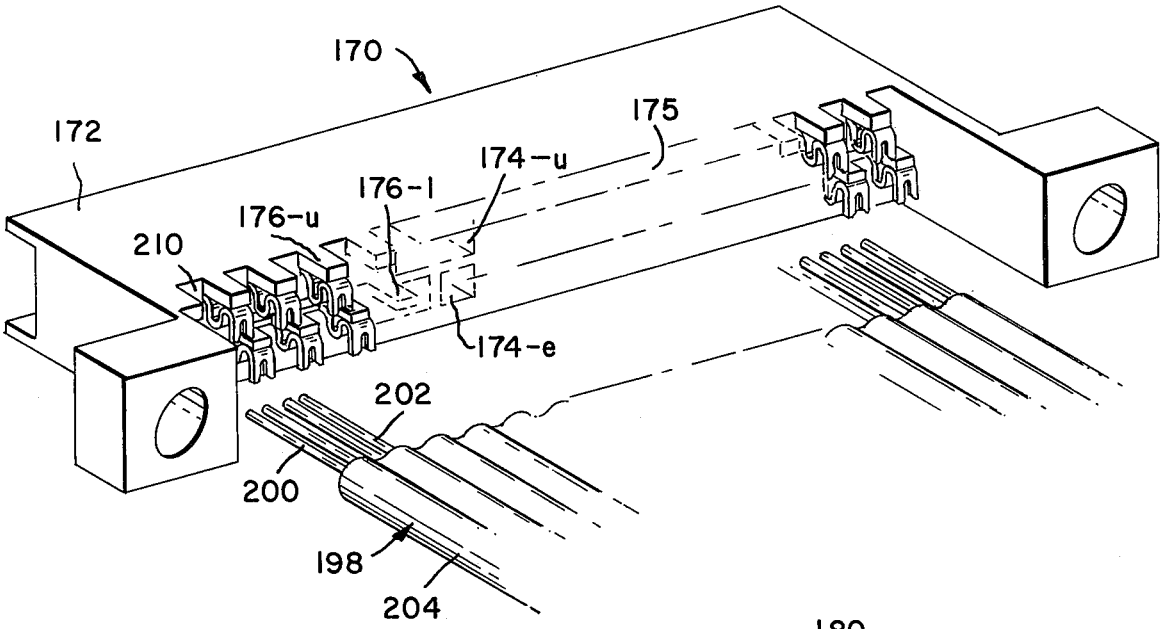
FIG. 6*a* is a perspective view of the back of the connector and the ribbon coaxial cable.

The connector which is used in conjunction with tool 10 is shown in FIG. 6*a* and is designated by reference numeral 170. Connector 170 consists of a housing 172 of insulating material such as glass-filled nylon. Two rows of passages 174 extend through the housing from front to back end 175. The rows are arranged in overlying relations with the upper passages being in direct alignment with the lower passages. The letters "U" and "L", added to reference numeral 175, designate the upper and lower rows.

A platform 176 projects rearwardly from the top edge of each passage; however the platform adjacent the upper passages, hereinafter designated by the reference numeral 176-U are horizontally offset to the left relative to the platforms adjacent the lower passages, hereinafter designated by reference numeral 176-L.

Figure 6B:
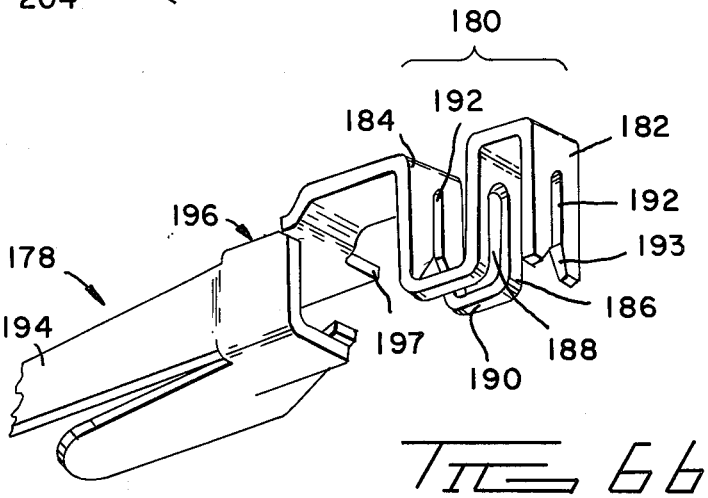
FIG. 6*b* is a view of a contact member housed in the connector of FIG. 6*a;*

With reference to FIG. 6*b* contact members 178 have on one end a terminal section 180 having first and second wire-receiving slotted blades 182 and 184 respectively. (See FIG. 9.) The second blade 184 is formed from one side of a U-shaped portion. The second side, positioned between blades 182 and 184 and designated by reference numeral 186, has a wide post receiving slot 188 therein and extending through bight 190, such width being compared to the smaller width slots 192 in blades 182 and 184 which receive the wires. Each wire-receiving slot 192 has a funnel shaped opening 193. The other end of the contact members 178 consist of a contact arm 194 (FIG. 9) suitable for electrical engagement with like contact arms in like connectors. An intermediate section 196 connects the contact arm to the terminal section.

The contact members, to the extent discussed, are identical. However the terminal sections 180 on the contact members which occupy the upper row of passages 174, hereinafter designated as contact members 178-U, are offset to the left relative to the intermediate section and the contact members occupying the lower row of passages, hereinafter designated as contact members 178-L, have their terminal section 180 offset to the right; all as viewed from the back as seen in FIG. 6*a*. The contact member in FIG. 6*b* is offset to the left as indicated by jog 197. The orientation permits the terminal sections to be aligned directly with the platforms 176 associated with the passages.

The ribbon coaxial cable 198 which is to be terminated to connector 170 is shown to the right in FIG. 6*a*. This cable consists of a plurality of signal wires 200 and a plurality of parallel drain wires 202. A dielectric sheath and foil sheath (neither are shown) surround each signal wire. An outer insulating jacket 204 provides a single covering for the signal and drain wires.

THE METHOD OF SIMULTANEOUS TERMINATION

Cable 198 is prepared for termination by removing jacket 204, the dielectric and foil so as to expose a length of signal and drain wires. Their are two options available with respect to such stripping and either is satisfactory. The stripping may be done at the end of the cable as shown in FIG. 6*a* or a section may be stripped at a short distance inwardly from end 205 as shown in FIG. 7. The latter method is preferred in that the insulation at the end of the cable maintains the wire alignment during storage and handling.

FIGS. 2 and 7 show that connector 170 is placed into the upper assembly 23 with the openings in the wire-in-slot blades facing downwardly toward the wire support assembly 38.

The front end 206 of the connector is slid into the space between block 112 and wire cutoff plate 48. Preferably the back end 175 is tilted downwardly until the front end 206 of the connector abuts a forwardly facing shoulder 208 on the underside of block 112. Then, as the back end of the connector is rotated or moved upwardly, the beveled portion 147 on teeth 144 enter into the spaces 210 (FIG. 6a) between platforms 176-U on the connector and in so doing align the connector. Further upward movment of the connector drives the first and second support plates 124 and 134 into position; i.e., the posts 126 and 136 rest against platforms 176-L as shown in FIG. 7 and the sides of the posts bear against the sides of blades 182 and 184 on contact members 178-U. Each blade is laterally supported between two adjacent posts. The beveled end on the posts facilitate the positioning. Further, the bottom edges of plates 132 and 140 are in abutting contact with platforms 176-U as well as the bases of slots 128 and 138 in plates 124 and 134 respectively.

The connector is held securely in the connector support assembly 110 by interference. As indicated in FIG. 7, the wire cutoff plate 48 is not in contact with connector housing 172 at this time.

Still with reference to FIG. 7, prepared cable 198 is placed into the wire support assembly 38 so that the signal wires 200 are lying through short slots 52 in comb 50 and on top of posts 60, 74 and 90 on plates 58, 72 and 88 respectively; the drain wires (not shown) are lying through long slots 54 in comb 50, and above slots 62, 76 and 92 in plates 58, 72 and 88 respectively. Note that the wires can be loaded into the assembly in the reverse order without material effect.

The next step is to move ram 22 and connector 170 downwardly. After traveling a short distance the upper assembly contacts wire cutoff blade 48 and it too is pushed downwardly toward the lower assembly 20. The aforementioned studs 162 on the underside of block 112 provides the proper spacing between that block and the forward shelf 148 on the plate 48 so that the connector housing 172 is now positioned between the two.

As the upper assembly approaches the lower assembly the blade or cutting edge 152 severs the end 205 of cable 198 extending back of plate 88 as shown in FIG. 8.

After the excess wire is cut off, the back end of connector 170 enters the wire support assembly 38, which projects up above block 36 and side panels 40.

As the lower contact members 178-L move down, blades 182 thereon pass directly in front of slots 62 on plate 58 and down into slots 68 on plate 64 so that the posts 66 bracket each blade. Blades 182 also pass directly in back of slots 76 on plate 72.

The second sides 186 and bights 190 move down into slots 76. Posts 74 bracket the sides.

The blades 184 pass directly in front of slots 76 and directly behind slots 92 in plate 88. The blades are moving down into slots 222 in plate 86 and down into slots 68 on plate 64 so that posts 66 and posts 220 bracket blades 182 and 184.

As the upper contact members 178-U move down, blades 182-U thereon pass directly in front of posts 60 on plate 58. As will be recalled, blades 182-U on the upper contact members are bracketed by posts 126 on plate 124 of the connector support assembly 110. Blades 182-U pass directly behind posts 74 on plate 72.

The second sides 186 and bights 190 move down onto posts 74, these posts being received in wide slots 188.

Blades 184-U pass directly in front of legs 80 on posts 74 and directly behind posts 90 on plate 88.

The lower platforms, 176-L, follow in the same path as the terminal sections 180 on the lower contact members 178-L; i.e., through the several slots defined by posts 68 (plate 64) and posts 74 (plate 72).

Further downward movement brings the signal and drain wires into contact with the wire-receiving slotted blades.

With respect to the lower contact members 178-L, first the drain wires 202, which initially were positioned across the several slots, are pushed down by the blades; i.e., the wires enter the funnel-shaped opening 193 but are stopped by the narrower slots 192 due to the lack of force on them initially. Further downward travel brings the wires into contact with the bottoms or bases of three slots, 62 (plate 58), 76 (plate 72) and 92 (plate 88). As the blades continue to move downwardly, the now stopped wires are staked or forced into the narrower portions of wire-receiving slots 192 on blades 182 and 184. Note that the wide slot 188 in second sides 186 and bights 190 permit blade 184 to travel down far enough to drive the wire to the bottom of the slot.

The upward forces created by the aforementioned staking operation are exerted on blades 182 and 184 and tends to cause them to move laterally. The posts 66 and 220 which bracket blades 182 and 184 respectively, restrain the two blades from such movement. The upward forces further push on platforms 176-L. That force is counteracted by downward pressure exerted on the top of the platforms by posts 126 (plate 124) and 136 (plate 134) on the connector support assembly 110.

Simultaneously, the signal wires 200 are being staked into the blades on the upper contact members 178-U. The comb 50 aligns the signal wires across the tops of posts 60 on plate 58, post 74 on plate 72 and posts 90 on plate 88.

As blades 182-U move down inbetween posts 60 and 74 the wires spanning the space between are driven into the wire-receiving slots. Concurrently as blades 184 move down inbetween posts 74 and 90, the wires are driven into the slots on those blades. Note that the T-shaped posts 74 move into the wide slot 188 on sides 186 and bights 190, thereby bringing the legs 80 on posts 74 close to the wire-receiving slot 192 in blades 184.

Lateral restraint is imposed on the blades on the upper contact members by virtue of being bracketed by posts 126 on plate 124 and posts 136 on plate 134. Upper pressure on platforms 176-U is counteracted by plates 132 and 140. As will be recalled, these plates are in connector support assembly 110.

Figure 9:
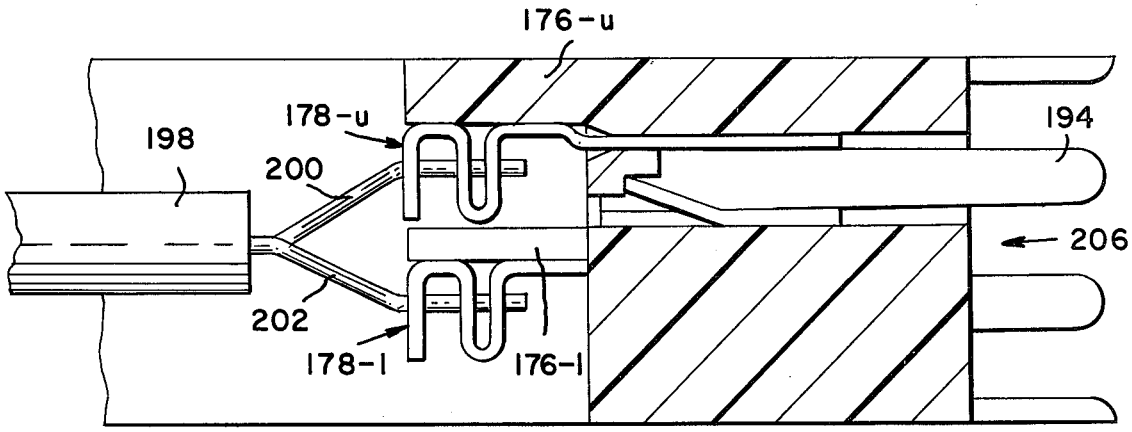
FIG. 9 is a side elevational, cross-sectional view of the connector of FIG. 6 subsequent to the staking operations depicted in FIGS. 7 and 8.

FIG. 9 is a drawing showing cable 198 terminated to connector 172. As is well known, excellent electrical termination and mechanical gripping is achieved using the wire-in-slot technique.

While ribbon coax cable termination is the prime objective of this invention, it can also be seen that any cable having parallel wires can be terminated in the tool of the present invention. Further, the stripping of the cable does not require stripping of the wires per se to bare metal. As is well known, the wire-receiving slots have the capability of cutting through insulation. Accordingly wires coated with an enamel for example do not require that the enamel be removed beforehand. Note also that the connector need not have two rows; i.e., a single row connector can be terminated as well.

The foregoing detailed description has been given for clearness of understanding only, and no unnecessary limitations should be understood therefrom, as some modifications will be obvious to those skilled in the art.

What is claimed is:

1. A tool for simultaneously staking a plurality of parallel wires into a connector having a plurality of contact members of the type having blades with wire-receiving slots extending outwardly from one end of the connector housing, said tool comprising:

a. frame means providing a base and an upper support member in vertical alignment with the base;

b. movable means positioned in the upper support member for vertical reciprocal movement and having a downwardly facing surface;

c. actuating means for moving the movable means;

d. a connector support plate having depending posts for laterally restraining said blades as wires are forced into the wire-receiving slots located therein;

e. at least two wire support means attached to the base and facing upwardly toward the connector support plate, said wire support means positioned one behind the other with a space between, said wire support means being for supporting a plurality of parallel wires spanning said space therein between, whereby as the movable means move a connector positioned therein downwardly the blades containing the wire-receiving slots enter the spaces between the wire support means and the portions of wires spanning the spaces are forced into the wire-receiving slots.

2. The tool of claim 1 further including a plate having a plurality of depending teeth for sliding in between the contact members adjacent the connector housing thereby aligning the connector positioned therein.

3. A tool for staking a plurality of parallel wires into a connector of the type having two rows of passages, one row over the other, with a platform extending rearwardly from one edge of each passage, the platforms on one row being offset laterally with respect to the platforms on the other row, and a plurality of contact members positioned in the passages, each contact member having a terminal section extending rearwardly from the passage, said terminal sections on the contact members in one row being offset laterally with respect to the terminal sections on the contact members in the other row so that the terminal sections are in alignment with the platforms, each terminal section having a first wire-receiving slotted blade at the end thereof and a second wire-receiving slotted blade inwardly from the first, said second blade being one side of a U-shaped portion of the terminal section with the second side and bight thereof having a continuous post-receiving slot therethrough, said tool comprising:

a. frame means for providing a base and an overhead support member;

b. movable means having a downwardly facing surface mounted in the overhead support member for vertical movement toward and away from the base;

c. actuating means for moving the movable means;

d. a connector support assembly mounted on the downwardly facing surface for holding said connector so that the openings to the wire-receiving slots face downwardly, said assembly including:

i. first and second plates having a plurality of depending posts extending through the platforms on the upper row and abutting the platforms on the lower row, the posts on the first plate bracketing and restraining the first blades in the upper row against lateral movement and the posts on the second plate bracketing and restraining the second blades in the upper row against lateral movement;

ii. third and fourth plates, the third positioned between the first and second plates and the fourth positioned on the other side of the second plate, said third and fourth plates bearing against the platforms on the upper row; and iii. a fifth plate having depending teeth and positioned on the other side of the fourth plate, said teeth extending between the platforms on the upper row and thereby locating the connector as it is placed into the connector support assembly;

e. a wire support assembly positioned on the base and consisting of:

i. a comb plate having a plurality of short and long slots spaced alternatively across the upper edge;

ii. first, second and third wire support plates spaced behind the comb plate with each having on the upper edge thereof a plurality of alternating posts and slots;

iii. first and second blade support plates positioned between the first and second and between the second and third wire support plates respectively and thereby providing spaces in alignment with the posts thereon, said blade support plates each having on the upper edges thereof a plurality of alternating posts and slots, whereby;

as a connector positioned in the connector support assembly is advanced into the wire support assembly, the blades enter into the slots on the first and second blade support plates so that the posts thereon bracket and thereby laterally support the first and second blades in the lower row, and the posts on the first, second and third wire support plates support the wires coming through the short slots on the comb plate so that those wires are forced into the wire-receiving slots in the first and second blades in the upper row and the bases of the slots on the first, second and third wire support plates support the wires coming through the long slots on the comb plate so that those wires are forced into the wire-receiving slots on the first and second blades in the lower row.

4. The tool of claim 3 further including a wire cutoff plate mounted below the connector support assembly and movable therewith, said wire cutoff plate being to trim the ends of the plurality of wires which extend beyond the third wire support plate in the wire support assembly.

5. The tool of claim 3 wherein the posts on the second wire support plate are T-shaped with the legs thereof sliding into the post-receiving slot in the second side and bight of the U-shaped portion of the terminal sections in the upper row.

6. The tool of claim 3 wherein the bases of the slots on the second wire support plate are T-shaped with the legs thereof sliding into the post-receiving slots in the second side and bight of the U-shaped portion of the terminal sections in the lower row.

7. The tool of claim 3 further including a second comb plate movably positioned between the second wire support plate and the second blade support plate and biased upwardly, said second comb plate having a plurality of slots in its upper edge to receive therethrough a plurality of parallel wires extending across the wire support assembly, said second comb plate being pushed downwardly by the U-shaped portion of the terminal sections in the lower row as the connector is moved downwardly into the wire support assembly.

* * * * *